US007080603B2

(12) United States Patent
Ulmer et al.

(10) Patent No.: US 7,080,603 B2
(45) Date of Patent: Jul. 25, 2006

(54) SEWING OR EMBROIDERY MACHINE

(75) Inventors: Christian Ulmer, Steckborn (CH); André Stucki, Steckborn (CH); Heinz Janouschek, Steckborn (CH)

(73) Assignee: Fritz Gegauf Aktiengesellschaft BERNINA-Nahmaschinenfabrik, Steckborn (CH)

( * ) Notice: Subject to any disclaimer, the term of this patent is extended or adjusted under 35 U.S.C. 154(b) by 0 days.

(21) Appl. No.: 10/894,612

(22) Filed: Jul. 20, 2004

(65) Prior Publication Data

US 2005/0028715 A1 Feb. 10, 2005

(30) Foreign Application Priority Data

Aug. 8, 2003 (CH) ..... 1366/03

(51) Int. Cl.
*D05B 57/14* (2006.01)

(52) U.S. Cl. ..... 112/231

(58) Field of Classification Search ..... 112/180, 112/181, 183, 186, 189, 196, 201, 231, 185, 112/279, 228

See application file for complete search history.

(56) References Cited

U.S. PATENT DOCUMENTS

| | | | | | |
|---|---|---|---|---|---|
| 862,033 | A * | 7/1907 | Toof | 112/168 |
| 2,671,420 | A * | 3/1954 | Backlin | 112/181 |
| 3,747,547 | A * | 7/1973 | Mayer et al. | 112/186 |
| 4,223,618 | A * | 9/1980 | Cislak | 112/186 |
| 4,681,050 | A * | 7/1987 | Kosmas | 112/278 |
| 5,143,004 | A * | 9/1992 | Mardix et al. | 112/186 |
| 5,400,730 | A * | 3/1995 | Moll et al. | 112/186 |
| 5,582,355 | A * | 12/1996 | Nakamura et al. | 242/562 |
| 5,718,181 | A * | 2/1998 | Shinozuka et al. | 112/186 |
| 5,904,110 | A * | 5/1999 | Kwang | 112/186 |
| 6,286,444 | B1 * | 9/2001 | Swaney | 112/117 |

* cited by examiner

*Primary Examiner*—Danny Worrell
(74) *Attorney, Agent, or Firm*—Volpe and Koenig, P.C.

(57) ABSTRACT

The hook (15) of a sewing machine (1) is mounted so that it can move on a hook carrier. Through a sliding movement of the hook carrier, the hook (15) is brought from its operating position into a bobbin case removal position. Through the sliding movement, the hook (15) with the bobbin case (17) is placed at or above the opening, which is created by the flap (13) in the lower arm (5). In this way, the removal of the bobbin case (17) or the bobbin is made considerably easier.

7 Claims, 7 Drawing Sheets

SEWING OR EMBROIDERY MACHINE

BACKGROUND

The invention is directed to a sewing or embroidery machine, and more particularly to a sewing or embroidery machine with a hook, which oscillates or rotates about a hook rotational axis, whose drive shaft is drivingly connected with a drive of the sewing machine.

The comparatively very minimal supply of bobbin thread in relation to the needle thread, which can be made available in any amount outside the sewing machine, forces the operator of a sewing or embroidery machine to remove the bobbin from the hook in the lower arm, flat bed, or base of the sewing machine and to replace it with a new one. In a sewing machine with a hook that rotates or oscillates about a vertical axis, to change the bobbin, the material to be sewn must be lifted from the needle plate and the bobbin must be detached from the hook with little or no sight of the bobbin and then the new bobbin must be inserted again into this hook. Also for hooks, which rotate or oscillate about a horizontal axis, the forward exchange of the bobbin requires a certain amount of skill, although for accessing the hook, the material to be sewn is disturbed less than for the first mentioned example. However, viewing the hook is made more difficult during the bobbin changing process. The tight spatial relations and the usually very small cross-sectional opening in the lower arm, through which the bobbin case containing the bobbin can be removed from the hook housing with two fingers, also makes the use of bobbins with a large amount of thread more difficult.

This disadvantage applies to all sewing machines, both household sewing machines and also industrial sewing machines, which require a fast bobbin exchange anyway for economical reasons.

Automatic bobbin or hook changing systems are already known for industrial or commercial machines.

From DE-C1-196 53 296, an embroidery machine with a hook exchanger is known, for which the entire hook, including bobbin and bobbin case, is removed from the hook drive by a handling device and is replaced by a new hook with a full bobbin. In a first configuration of this known arrangement, the handling device includes a revolver carrier, on which the hook with the empty bobbin is set and is pivoted about an axis after being removed from the hook drive and then the full hook is set on the hook drive. Here, the revolver of the handling device completes not only a rotational movement, but also simultaneously a translational movement. Such an arrangement is definitely able to replace an empty bobbin with a new one within a short time period. However, then the hook with the empty bobbin must be removed from the handling device and the bobbin must be detached from the hook and replaced by a new, full bobbin. Such an arrangement cannot be used in a household sewing machine with a free arm for reasons of space and also the costs for such a hook changing device are out of proportion with the costs of the sewing machine. Consequently, the use of such a hook exchanger is limited to industrial flat-bed, embroidery, or sewing machines. Use in a free-arm household sewing machine is not possible.

From EP-A1-0829565, an automatic bobbin exchanger for a flat-bed sewing machine is further known, for which the empty bobbin together with the bobbin case is discharged from the hook with a handling device that can move on a curved track, the bobbin and bobbin case are fed to a revolver carrying several bobbin cases with bobbins, and then this revolver supplies a bobbin case with a full bobbin, which is brought to the hook. This arrangement can also be used only in commercial machines.

From DE-A1 199 07 007, an adjustable hook is further known, which can be shifted in the axial direction in the range of a few tenths of a millimeter in order to compensate for production inaccuracies after the assembly of the sewing machines. This minimal forwards or backwards sliding of the hook does not simplify the bobbin exchange, because the hook cannot be moved away from the lower arm.

SUMMARY

The object of the present invention is to create a sewing or embroidery machine, which enables the simple exchange of the empty bobbin by a full bobbin without using a complicated handling device. Another object of the invention is to allow the arrangement enabling the simple exchange of the bobbin to be arranged inside the free arm of a household sewing machine.

This object is realized by a sewing or embroidery machine according to the present invention, in that the hook is located on a bearing that provides a sliding movement so that it can be moved out of the operating position in the lower arm into at least one bobbin exchange position, which is at a distance from the operating position and which simplifies the removal of the bobbin.

The placement of the hook on a sliding arrangement enables this hook to be moved from its hard-to-access operating position into an optimum bobbin exchange position that is easy to access during the bobbin exchange. During the pivoting motion, the hook itself always remains in intermeshing, i.e., positive-fit, contact with its drive, so that after the bobbin exchange, the hook again assumes the same exact rotational angle position as before the bobbin exchange.

Another advantage of the invention is that after the production of the sewing machine, the adjustment of the hook relative to the needle is possible with very minimal expense. In addition, later adjustments, e.g., after a machine revision, can be performed without any trouble. The technical expense for realizing the sliding movement of the hook is extremely low and is essentially limited to a sliding bearing, which carries the hook shaft and the hook.

The hook that can move according to the invention further enables the sewing of long stitches, e.g., for tacking. By slightly moving the hook during the down-stitch of the needle, the needle thread is not hooked and this thread is pulled out from the material to be sewn again by the needle and in this way a stitch is "skipped." The slight misalignment of the hook, which is necessary for this measure, allows longer stitches than before to be created in a simpler way, without requiring, e.g., the needle bar to be detached from the drive.

BRIEF DESCRIPTION OF THE DRAWINGS

The invention is described in more detail with reference to illustrative embodiments. Shown are.

DETAILED DESCRIPTION OF THE PREFERRED EMBODIMENTS

Figure 1:
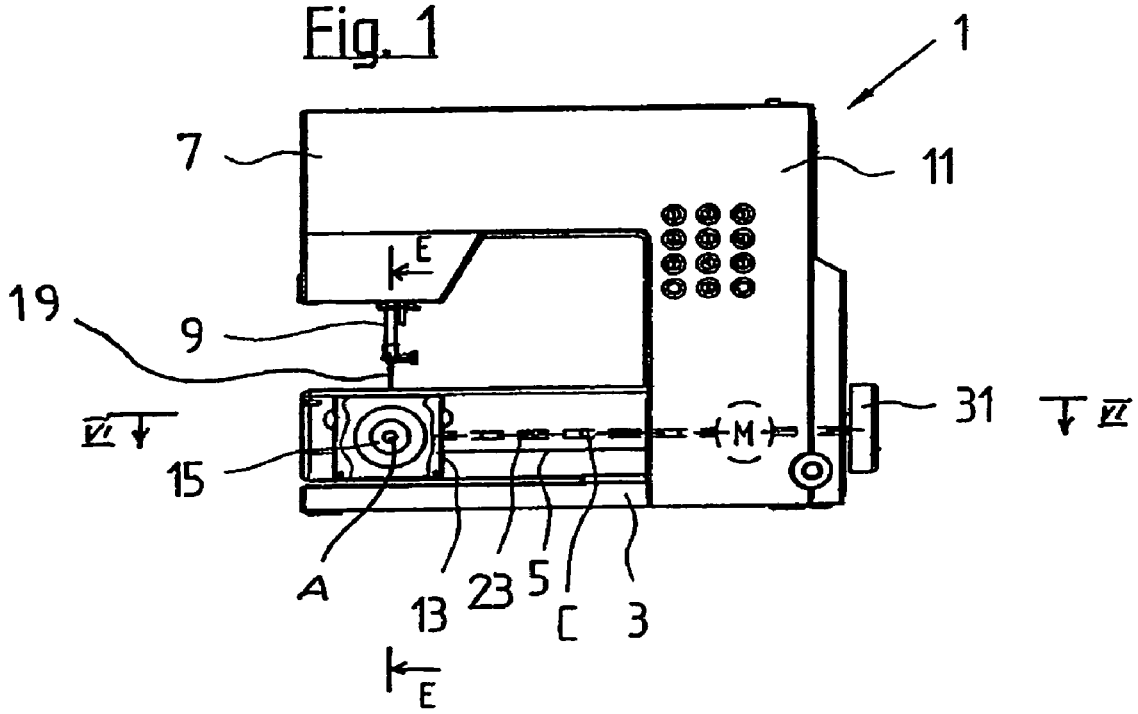
FIG. 1 is a view of a household sewing machine with a free arm shown from the side of the operator with partially cut-away flap on the lower arm.

For better illustration of the invention, in FIG. 1 a household sewing machine 1 is shown in a simplified diagram. This includes a base plate 3, a lower arm or free arm 5 arranged at a distance above this base plate, an upper part 7 of the machine connected to the base plate 3 by a vertical column 11, which contains drive elements. Further shown is a needle bar 9 with a needle 19 and a partially cut-away flap 13, which provides access to a hook 15 with a bobbin case 17 rotating about an axis A, on the lower arm 5.

Figure 2:
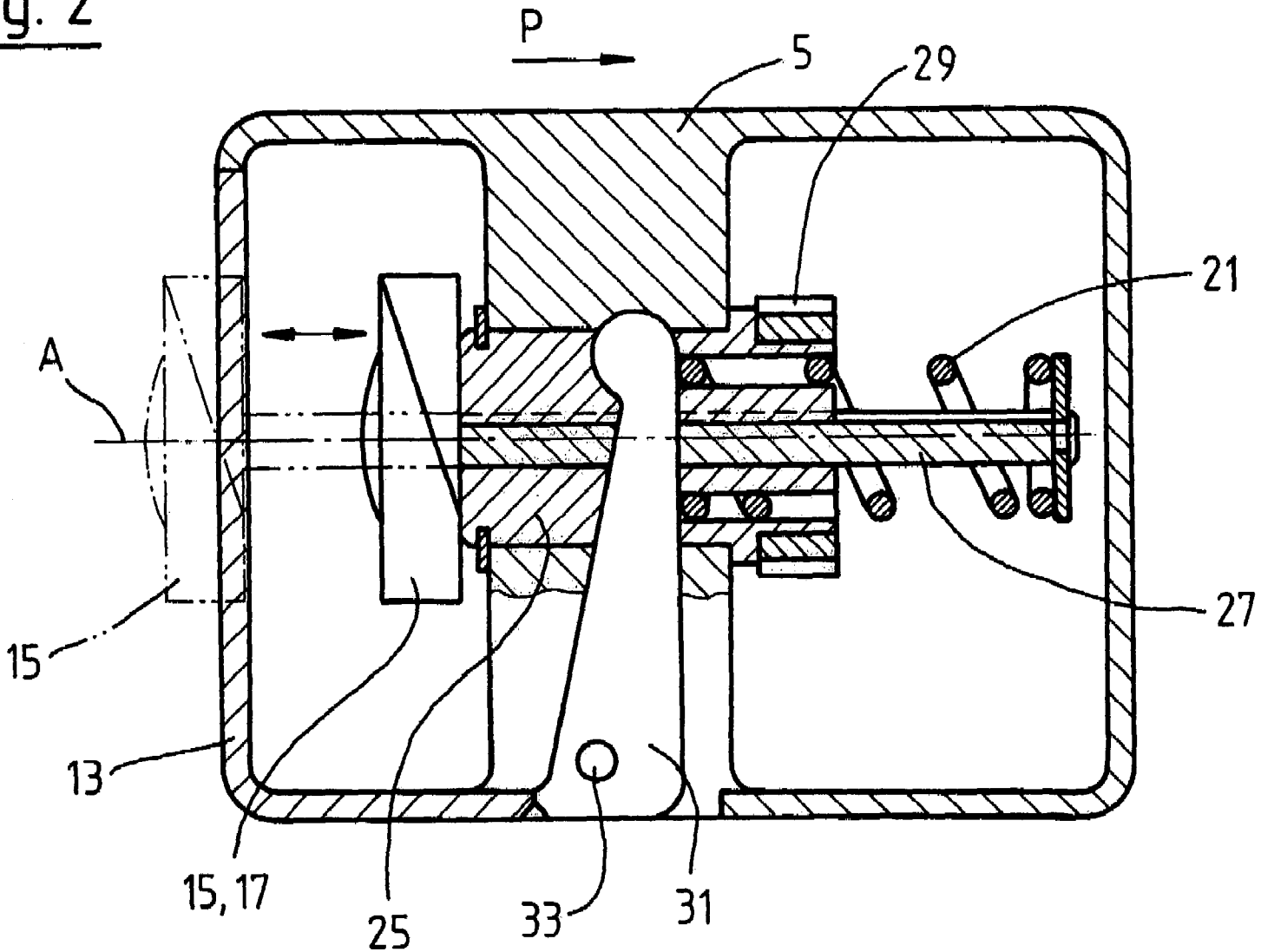
FIG. 2 is a vertical section through the lower arm in the sewing plane section E—E with a rotating hook with horizontal rotational axis in operating position, and the feed dog omitted.
Figure 6:
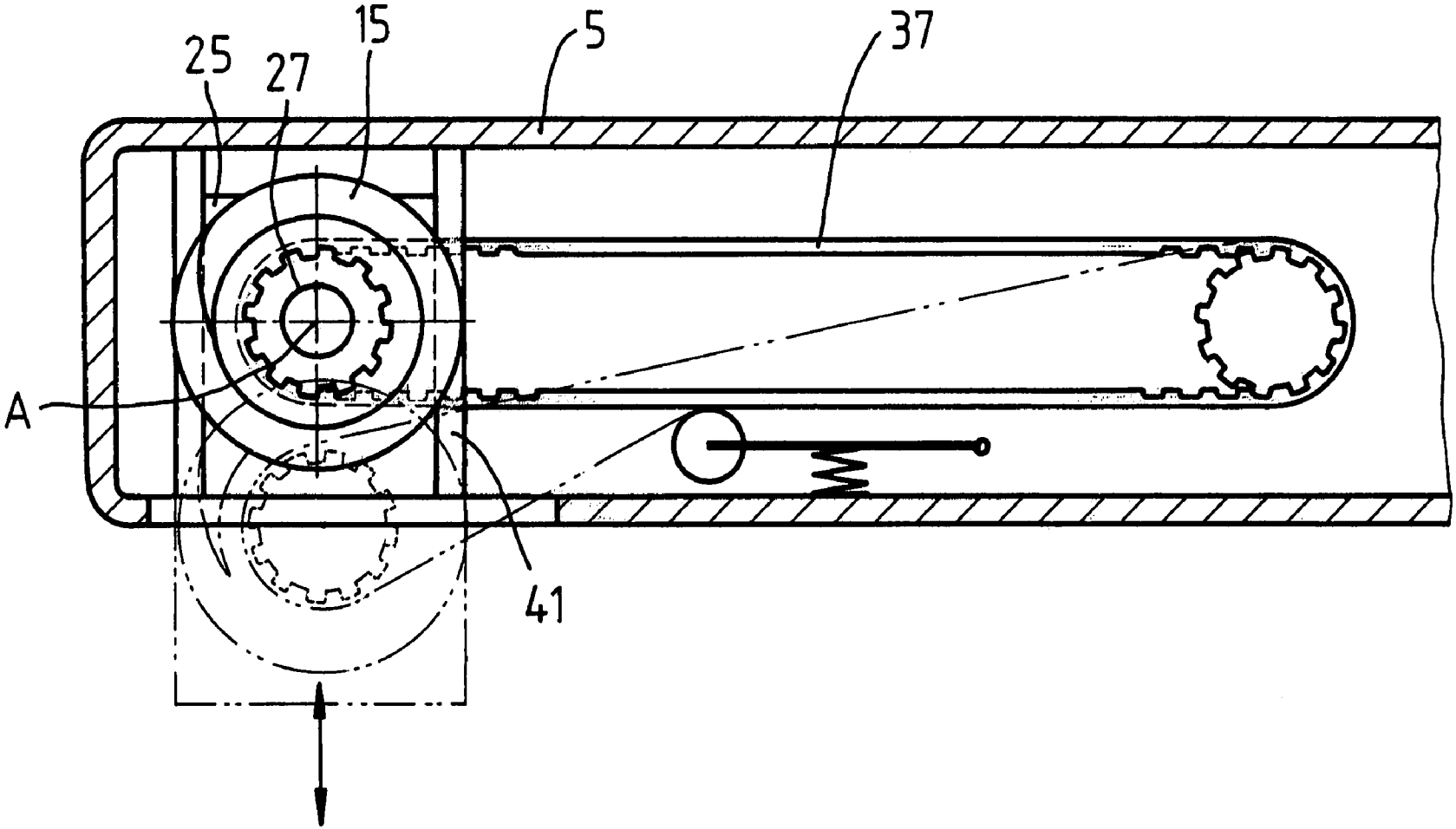
FIG. 6 shows a sectional view of another configuration of the hook with a vertical axis, taken along line VI—VI in FIG. 1.

In the enlarged view of a vertical section along line E—E in FIG. 1, the hook 15 with a bobbin case 17 is shown in turn in FIG. 2, as it is used in a sewing machine 1 according to FIG. 1. Viewed in the sewing direction P, the presser foot (not shown) lies behind the needle 19. The flap 13 is closed. The bobbin lies in the bobbin case 17 and is not visible in the figures. The driven gear, which is set on the end of the main shaft 23 of the sewing machine 1 in the lower arm 5, is not visible in the figures. The main shaft 23 is driven by a drive motor M, which is shown schematically in FIG. 1 by a circle. The main shaft 23 is mounted so that it can rotate in the lower arm 5. Alternatively, another type of drive for the hook 15 is possible (for example, the belt drive in FIG. 6). Also, a servo motor (not shown), which is attached at the back of the hook 15, can be used.

The hook shaft 27 carrying the hook 15 is mounted on a hook carrier 25 so that it can move in the axial direction. At the end of the hook shaft 27 there is a drive gear 29, which intermeshes with the teeth of the driven gear or a belt, i.e., it is in positive-fit engagement with the drive. A coil spring 21 turning with the shaft holds the hook shaft 27 with the hook 15 in the pushed-in operating position (continuous lines). In this position, the hook 15 contacts the hook carrier 25. With a pivot lever 31 attached to a pivot pin 33, the hook shaft 27 can be shifted to the left until the hook 15 is partially or completely out of the lower arm 5 when the flap 13 is open (shown in broken lines). In this position, the bobbin case 17 and the bobbin lying therein can be accessed without any obstacles. The pivot pin 33 can coincide with the pivot pin of the flap 13. Preferably, the pivot lever 31 is part of the flap 13. This enables the hook 15 to be moved out of the lower arm 5 in sync with the opening of the flap 13.

In the exemplary embodiments, the needle 19 enters into the material to be sewn on the side of the hook front with the bobbin removal opening seen in the sewing direction P (the latter is not shown). This typical arrangement for household sewing machines is selected in this way to allow the bobbin case 17 to be removed from the lower arm 5 on the side of the operator, without requiring the material to be sewn to be removed beforehand.

Figure 3:
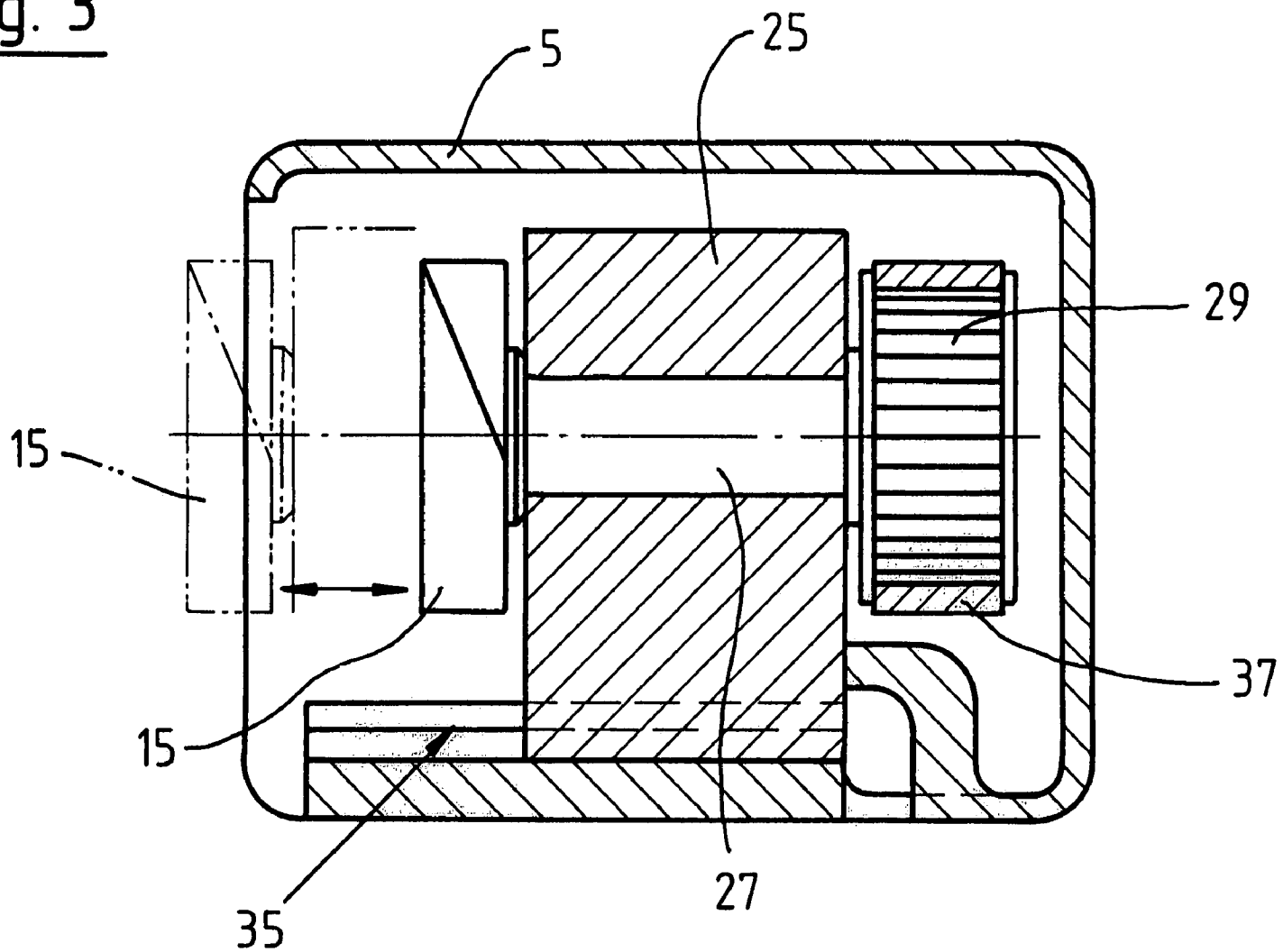
FIG. 3 shows another configuration of the hook.

FIG. 3 shows the hook 15, whose shaft 27 is mounted so that it can rotate in the hook carrier 25. The hook carrier 25 sits on a linear or sliding bearing 35, e.g., a dovetail guide or a roller guide. With an adjustment arrangement not shown in more detail, the hook carrier 25 with the hook 15 mounted thereon so that it can rotate can be conveyed out of the operating position in the axial direction into the bobbin exchange position (shown in broken lines). In this example, the hook 15 is driven with a toothed belt 37. The lateral offset of the toothed belt 37 during the bobbin exchange and subsequent stationary machine can be absorbed by the elasticity of the toothed belt 37.

Figure 4:
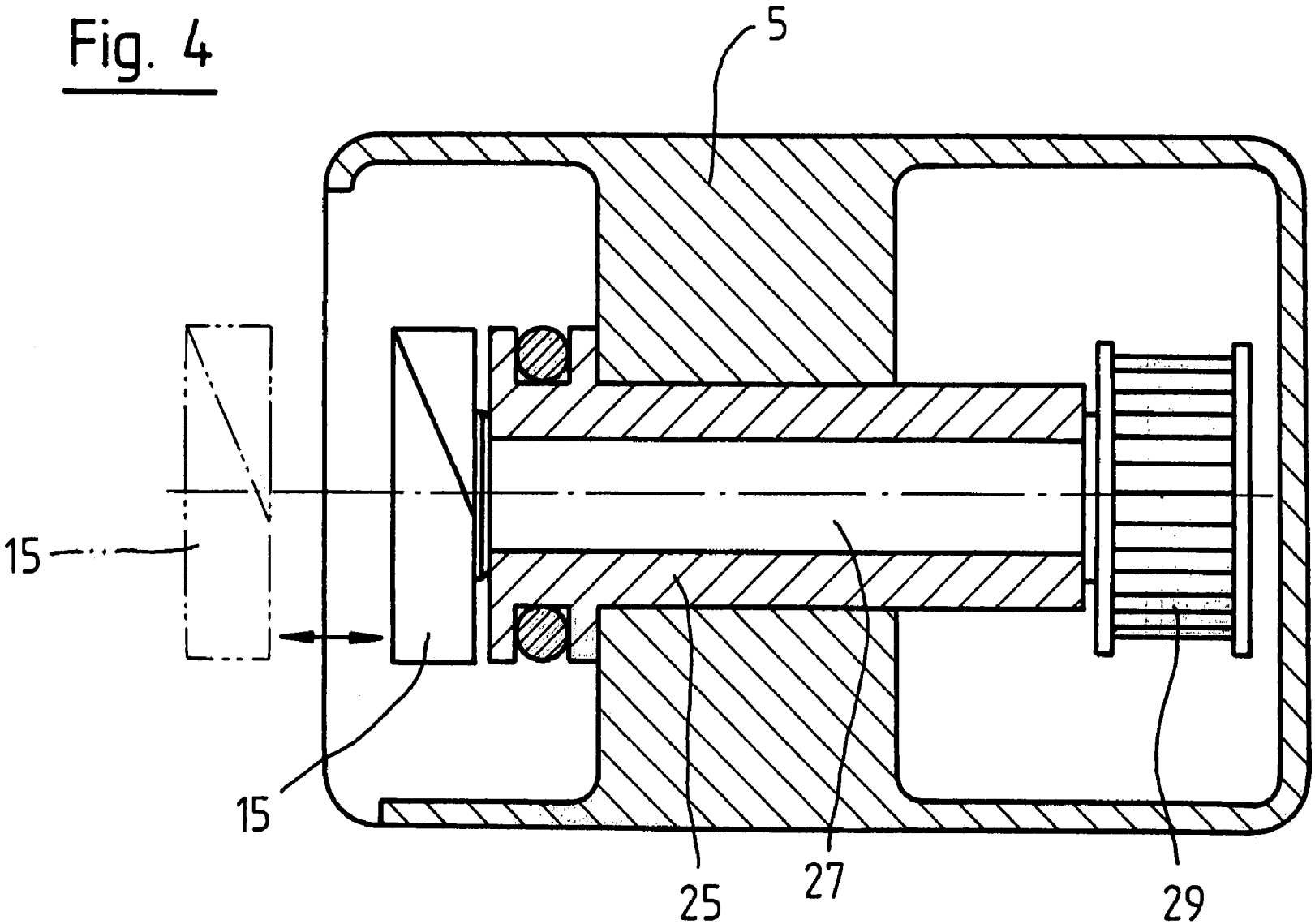
FIG. 4 shows another configuration of the hook.

In the embodiment according to FIG. 4, the hook carrier 25 is mounted in the lower arm 5 so that it can slide in the axial direction. The drive gear 29 shifts in the axial direction like in the previously described example, when the hook 15 is moved out of the lower arm 5.

Figure 5:
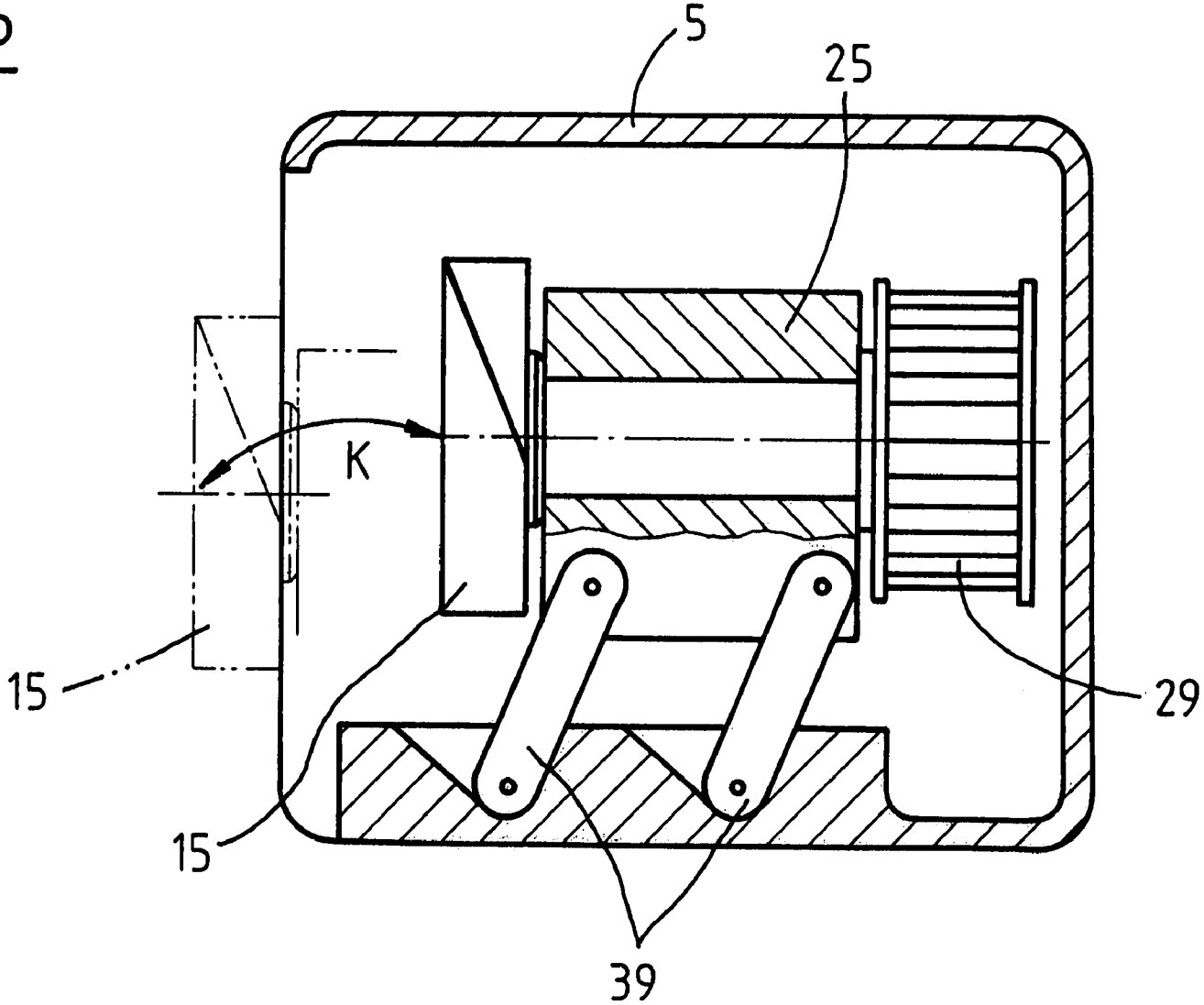
FIG. 5 shows another configuration of the hook.

In the embodiment according to FIG. 5, the hook carrier 25 sits on at least two pivoting carriers 39. These are linked on one side to the lower arm 5 and on the other side to the hook carrier 25 and form a four-bar linkage. Through activation means not shown in more detail, like the flap 13 or a lever (not shown), the hook carrier 25 with the hook 15 mounted thereon can be conveyed from the operating position (continuous lines) into the bobbin exchange position (broken lines). By pivoting the carrier 39, the hook 15 is moved not only from the lower arm 5, but also downwards. The lowering of the hook 15 that has been moved out also improves the accessibility for the bobbin exchange.

Figure 7:
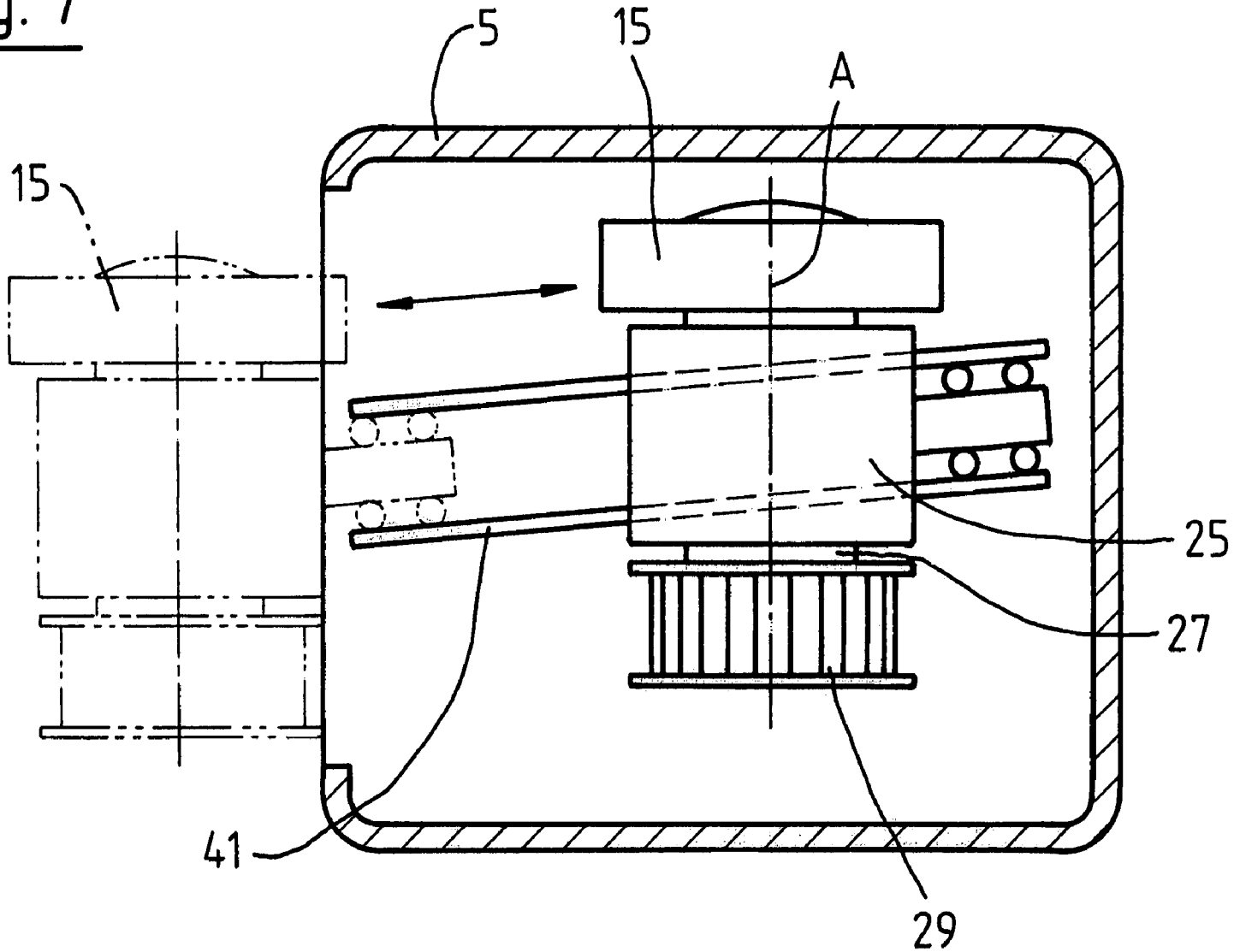
FIG. 7 is a sectional view through the hook part of the lower arm with the remote position of the hook shown in broken lines.

The invention can also be used for hooks 15 mounted so that they rotate horizontally. FIGS. 5 and 7 show one possible embodiment. The vertical hook shaft 27 is in turn mounted in a hook carrier 25. This can be pushed on a linear or bent rail 41 horizontally or diagonally downwards from the lower arm 5. With a suitable guide, the drive toothed belt 37 can follow this sliding motion (see FIG. 6).

Obviously, it is also conceivable for the outwards sliding movement to be realized, e.g., by a mechanical connection between the flap 13 on the lower arm 5 and the hook carrier 25. It is further possible to realize the sliding movement of the hook carrier 25 by an electronic drive.

In addition, the operating position and the exchange position are shown in each of the figures. However, it is also possible the remove or eject the bobbin or the bobbin case 17 in an intermediate position and to insert the full bobbin in a different shifted position.

In all embodiments, suitable sensors guarantee that the drive of the needle is interrupted at the beginning of the sliding movement of the hook carrier 25.

Legend

1 Sewing machine
3 Base plate
5 Lower arm
7 Upper part of machine
9 Needle bar
11 Column
13 Flap
15 Hook
17 Bobbin case
19 Needle
21 Coil spring
23 Main shaft
25 Hook carrier
27 Hook shaft
29 Drive gear
31 Pivot lever
33 Pivot pin
35 Linear bearing
37 Toothed belt
39 Pivoting carrier
41 Rail

The invention claimed is:

1. Sewing or embroidery machine (1) comprising a hook (15), which oscillates or rotates about a hook rotational axis (A), with a drive shift (27) in drive connection with a drive (M) of the sewing machine (1), the hook (15) is mounted on a support that provides a sliding or translational movement and can be moved out of an operating position in a lower arm (5) into at least one bobbin exchange position, which is at a distance from the operating position, and which simplifies removal of the bobbin.

2. Sewing or embroidery machine according to claim 1, wherein the hook (15) is mounted for sliding movement in an axial direction or parallel to the hook rotational axis (A) from the operating position into at the least one bobbin exchange position.

3. Sewing or embroidery machine according to claim 1, wherein the hook (15) is mounted for translational movement on a parallelogram parallel to the hook rotational axis (A) along a curve (K) from the operating position into the at least one bobbin exchange position.

4. Sewing or embroidery machine according to claim 1, wherein the drive connection between the hook (15) and the drive (M) is maintained during movement of the hook (15) from the operating position into the one or more bobbin exchange positions.

5. Sewing or embroidery machine according to claim 1, wherein the sliding movement of the hook (15) is triggered by opening of a flap (13) on the lower arm (5).

6. Sewing or embroidery machine according to claim 1, wherein the sliding movement of the hook (15) is triggered by a lever (31).

7. Sewing or embroidery machine according to claim 1, wherein the sliding movement of the hook (15) is realized by a motive drive.

* * * * *